United States Patent [19]

Jones et al.

[11] Patent Number: 4,527,688

[45] Date of Patent: Jul. 9, 1985

[54] TOY STORAGE CASE

[75] Inventors: Lawrence T. Jones, Playa del Rey; R. Stephen Lee, Westlake Village; Walter Moe, Santa Monica; Ashley G. Howden, Los Angeles; Paul J. Ishikawa, Hermosa Beach, all of Calif.

[73] Assignee: Universal International Holdings (USA), New York, N.Y.

[21] Appl. No.: 511,395

[22] Filed: Jul. 6, 1983

[51] Int. Cl.[3] ..... A63H 33/00; B65D 69/00

[52] U.S. Cl. ..... 206/315.1; 206/457; 206/579; 206/822; 446/75; 446/76

[58] Field of Search ..... 206/45.19, 315.1, 457, 206/579, 822; 46/11; 446/75, 76

[56] References Cited

U.S. PATENT DOCUMENTS

| | | | |
|---|---|---|---|
| 3,209,870 | 10/1965 | Johns | 206/315.1 |
| 3,871,519 | 3/1975 | Groomes | 206/315.1 |
| 3,889,805 | 6/1975 | Korten | 206/579 |
| 4,030,235 | 6/1977 | Terzian et al. | 46/11 |
| 4,165,579 | 8/1979 | Chase | 46/11 |
| 4,285,157 | 8/1981 | Lambert | 206/579 |
| 4,356,915 | 11/1982 | Phillips | 206/315.9 |

*Primary Examiner*—William Price
*Assistant Examiner*—Brenda J. Ehrhardt
*Attorney, Agent, or Firm*—Joseph W. Price

[57] ABSTRACT

A case for storing a collection of toy vehicles or models which simulates the appearance of the steering wheel of a vehicle. The case includes top and bottom members, each having a circular profile, which mate in a clam-shell manner. The members are connected together by a hinge mechanism which is secured in a closed position by a latch. An opening extends through the top and bottom members to form a carrying handle.

1 Claim, 4 Drawing Figures

TOY STORAGE CASE

BACKGROUND OF THE INVENTION

1. Field of the Invention

The present invention relates generally to the field of storage cases and more particularly to handheld cases for storing toy vehicle collections and the like.

2. Background Art

There exists a wide variety of cases for storing small collectible items such as small toy vehicles. One such case is similar to a briefcase in appearance and is provided with a plurality of individual compartments for receiving the vehicles. The cover of the case is transparent, thereby permitting the collection to be viewed without the necessity of opening the case.

A primary disadvantage of such prior art cases is that they are rather ordinary in appearance. The present invention overcomes this disadvantage inasmuch as it is attractive in appearance, yet accomplishes the desired function of storing and transporting a toy vehicle collection. This and other advantages of the present invention will become apparent to those skilled in the art upon reading the following detailed description of the invention together with the drawing.

SUMMARY OF THE INVENTION

A case for storing a collection of toy vehicles and which simulates the appearance of a steering wheel of a vehicle is disclosed. The case includes a bottom member which is coupled to a top member by way of a hinge. The bottom member mates with a cover member in a clamshell manner so as to form a closed compartment for receiving the vehicles. A latch is provided for securing the cover and bottom members together in the closed position. The cover member preferably includes raised sections which simulate the appearance of the spokes and the rim of the steering wheel.

The bottom section of the case includes a plurality of partitions which define compartments for receiving the individual toy vehicles. The bottom member also includes a relatively large opening which coincides with a corresponding opening in the top member when the members are in the closed position. The opening forms a convenient handle which facilitates carrying the case.

DETAILED DESCRIPTION OF THE INVENTION

Figure 1:
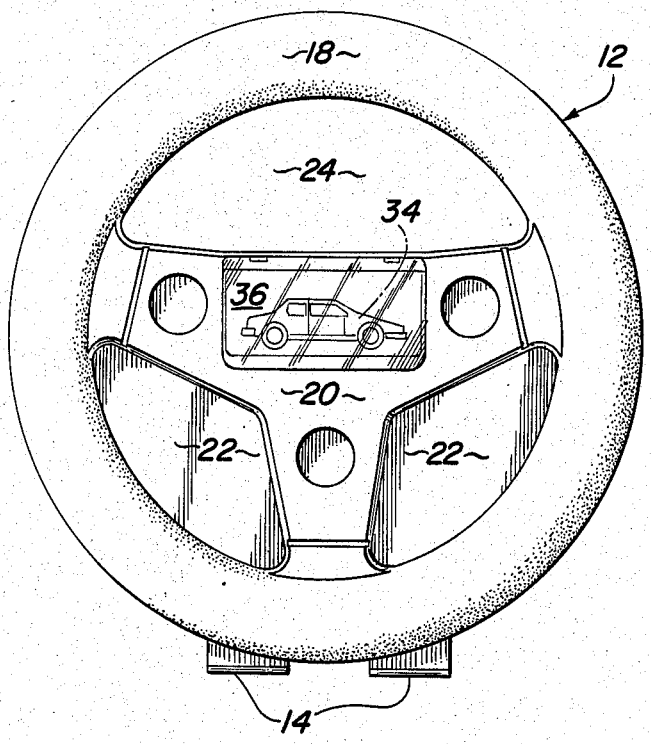
FIG. 1 is a plan view of the subject storage case.

Referring now to the drawings, the subject storage case is comprised of a bottom member, generally designated by the numeral 10, and a cover member, generally designated by the numeral 12. The cover and bottom members are coupled together at one end by a hinge mechanism 14. A latch 16 is provided at the opposite end for securing the case in a closed position.

The storage case is preferably fabricated from a thermoplastic plastic such as polypropylene using well-known injection molding techniques. It is preferable that the top and bottom members 10 and 12, hinge mechanism 14 and latch 16 be molded in a single step to form an integral unit. The central portion of the hinge mechanism 14 includes a relatively thin cross-section which provides flexibility so that the mechanism may be folded upon itself to form what is termed a "living hinge." Similarly, the juncture between the latch 16 and the cover member 12 (FIG. 4) is also relatively thin so as to provide flexibility.

The cover and bottom members are fabricated to simulate the steering wheel of a race car. Both members have a generally circular profile and are dimensioned to mate with one another in the manner of a clamshell to form a torus shaped storage case. The cover member 12 is provided with a raised annular-shaped section 18 around the periphery which corresponds to the gripping portion or rim of a steering wheel. A central raised section 20 having a generally T-shape is included in the cover member which simulates the spokes of the steering wheel. A pair of panels 22 are disposed between sections 20 and the outer raised section 18. The upper periphery of the central raised section 20 and lower periphery of the outer raised section 18 define an opening, which, together with a corresponding opening in the bottom member, form a case opening 24.

Figure 2:
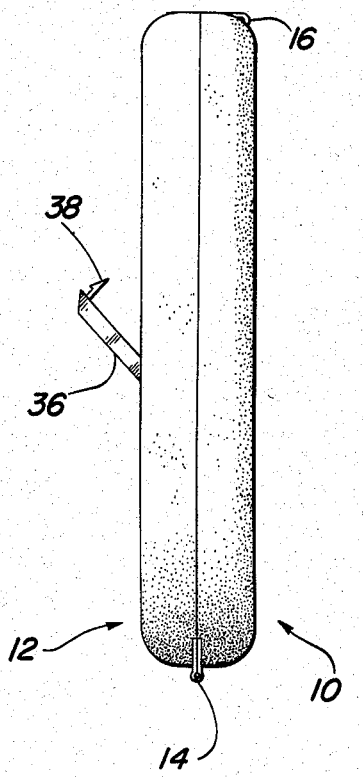
FIG. 2 is a side elevational view of the subject storage case showing the cover panel of the display compartment in an open position.

Bottom member 10 includes a smooth bottom panel (not designated) which extends over an area which generally corresponds to the area encompassed by sections 20 and 22 of the cover member. The bottom member includes an opening which, together with the opening in the cover member, form the case opening 24. As can best be seen in FIGS. 2 and 3, the bottom and cover members have curved sidewalls (not designated) to form a somewhat rounded continuous surface when the members are mated. Similarly, the periphery of the bottom and cover members which define opening 24 include sidewalls (not designated) which form a continuous surface. The continuous surface is flat in the region adjacent raised section 20 and rounded in the region opposite the raised section. Thus, when the bottom and cover members are mated, a closed compartment is formed including an enclosed portion which extends around opening 24.

Figure 3:
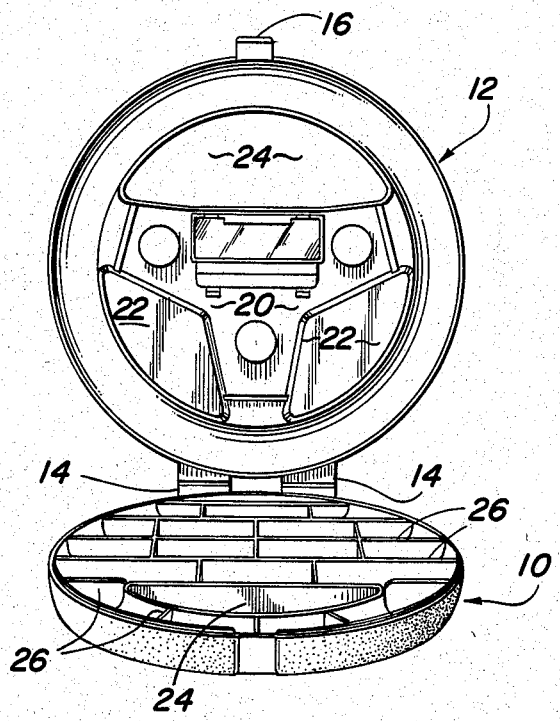
FIG. 3 is a perspective view of the subject storage case with the main cover open.

As can be seen in FIG. 3, bottom member 10 is provided with a plurality of partitions 26, some of which are positioned at right angles with one another. Partitions 26, together with the sidewalls of the bottom member, define a series of compartments for receiving the toy vehicles or models to be stored. Some of the compartments are positioned around the periphery of opening 24.

Figure 4:
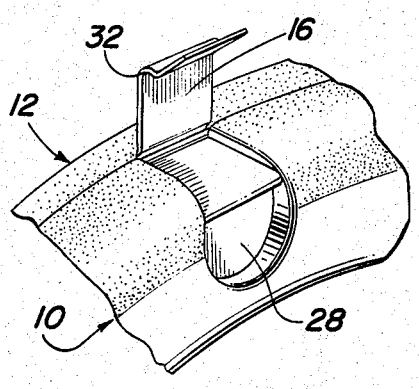
FIG. 4 is an enlarged sectional view showing some of the details of the cover latching mechanism.

Referring now to FIG. 4, latch 16 is received by a recess 28 formed in bottom member 10. A ridge or lip 30 is positioned within recess 28 which is generally traverse to latch 16. Latch 16 is provided with a curved section 32 so that when the resilient latch is pushed into recess 28, curved section 32 will snap over lip 30, thereby securing the cover in a closed position. The case may be opened by simply grasping the end of latch 32 and pulling the latch away from bottom member 10.

The cover member 12 also preferably includes a display compartment for receiving a toy vehicle 34 (FIG. 1). The compartment, which is an integral part of the cover member, includes a transparent plastic cover 36 which permits vehicle 34 to be viewed. Cover 36 is secured to the cover member by hinges (not designated) to provide access to the vehicle. The transparent cover is also provided with a pair of locking members 38 (FIG. 2) which secure the cover in place.

In the preferred embodiment, the portion of the bottom and top members which simulate the rim of a steering wheel are provided with a textured surface. Panels 22 of the top member and the bottom panel of the bottom member preferably have smooth surfaces, as does raised section 20. In order to more closely simulate a steering wheel, it is also preferred that raised section 20 have a metallic finish, whereas the remainder of the case is provided with a dark finish.

Thus, a novel storage case has been disclosed. The case may be easily carried in one hand using the handle formed by opening 24. The case may be hung on a wall by positioning opening 24 over a mounting hook or the like. While a preferred embodiment of the subject storage case has been described in some detail, it is to be understood that certain obvious changes can be made by persons skilled in the art without departing from the spirit and scope of the invention as defined by the appended claims.

What is claimed is:

1. A combination novel storage case for toy vehicles and simulated steering wheel for a vehicle comprising:

a circular profile bottom member having a plurality of separate compartments extending across the entire surface of the bottom member, each compartment being of a dimension to receive at least one toy vehicle, the bottom member further having an opening;

a first circular profile cover member connected to the bottom member to permit a hinged pivotal relative movement, the cover member further having an opening, the respective openings being of a dimension to permit a child to grasp and carry the storage case, the first cover member further having a raised section to simulate spokes of a steering wheel, the peripheral portions of the bottom member and the first cover member forming a torus shaped configuration when joined together to simulate a vehicle steering wheel, the torus shaped configuration extending around the opening and providing a series of separate compartments separated by partitions around the opening;

a movable second cover member of a transparent plastic material positioned at the centroid of the torus shaped configuration and closing a display compartment, whereby the child can display a predetermined vehicle in the center of the simulated steering wheel;

a hinge coupled to the bottom and cover members to permit relative movement and access to all of the separate compartments, and latching means for releasably latching the bottom and cover members together in a closed position.

* * * * *